US008210653B2

(12) United States Patent
Imamura et al.

(10) Patent No.: US 8,210,653 B2
(45) Date of Patent: Jul. 3, 2012

(54) MANUFACTURING METHOD OF PRINT HEAD AND PRINT HEAD

(75) Inventors: Isao Imamura, Kawasaki (JP); Akihiko Shimomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 430 days.

(21) Appl. No.: 12/486,066

(22) Filed: Jun. 17, 2009

(65) Prior Publication Data

US 2009/0315948 A1 Dec. 24, 2009

(30) Foreign Application Priority Data

Jun. 20, 2008 (JP) ..... 2008-161759

(51) Int. Cl.
*B41J 2/14* (2006.01)
*B41J 2/16* (2006.01)
*B21D 53/76* (2006.01)
*B21D 17/00* (2006.01)

(52) U.S. Cl. ..... 347/50; 29/890.1

(58) Field of Classification Search ..... None
See application file for complete search history.

(56) References Cited

U.S. PATENT DOCUMENTS 4,173,551 A 11/1979 Crivello
5,758,417 A 6/1998 Kobayashi et al.
7,425,057 B2 9/2008 Harada et al.
7,600,857 B2 10/2009 Kihara et al.
2005/0078143 A1 4/2005 Shimomura et al.
2006/0139410 A1* 6/2006 Kawamura et al. ..... 347/58
2006/0230614 A1 10/2006 Imamura et al.
2009/0141085 A1 6/2009 Kihara et al.

FOREIGN PATENT DOCUMENTS

JP 54-102394 8/1979
JP 2004-351754 12/2004

OTHER PUBLICATIONS

Crivello et al., "Diaryliodonium Salts as Thermal Initiators of Cationic Polymerization", Journal of Polymer Science: Polymer Chemistry Edition, vol. 21, 97-109 (1983).
Crivello et al., "New Photoinitiators for Cationic Polymerization", Journal of Polymer Science: Symposium No. 56, 383-395 (1976).

* cited by examiner

*Primary Examiner* — Matthew Luu
*Assistant Examiner* — Renee I Wilson
(74) *Attorney, Agent, or Firm* — Fitzpatrick, Cella, Harper & Scinto

(57) ABSTRACT

Sealants discharged from a syringe are irradiated with activation energy rays from a lamp. Thereby, it takes a predetermined time until the curing of the sealant begins after the irradiation of the activation energy rays. Therefore, the sealant can pass through between the lead wires in the meantime. As a result, a necessary amount of the sealant can enter into the lower side of the lead wire. Thereafter, the sealant begins to be cured and is gradually cured. In consequence, the sealant does not go through between the lead wires to flow into the lower side of the lead wire or flow out into locations other than the sealing location, and can gradually accumulate at the upper side of the lead wire to provide a sufficiently thick sealant.

9 Claims, 6 Drawing Sheets

MANUFACTURING METHOD OF PRINT HEAD AND PRINT HEAD

BACKGROUND OF THE INVENTION

1. Field of the Invention

The present invention relates to a manufacturing method of a print head for ejecting ink and a print head manufactured by the manufacturing method.

2. Description of the Related Art

An ink jet printing apparatus using a print head for ejecting ink is a printing apparatus of a non-impact type, and has advantages such as high-speed printing, capability of performing printing to various types of printing medium and almost no generation of noises at a printing operation. A representative example in an ejection system of the print head used in this type of ink jet printing apparatus uses electro-thermal conversion elements as ejection energy generating elements. In this system, the electro-thermal conversion element is provided in a pressuring chamber and an electrical pulse as a printing signal is applied to the electro-thermal conversion element to give thermal energy to ink, thereby using an air bubble pressure at foaming (at boiling) of ink generated due to a phase change of the ink at that point, for ejecting the ink. As a structure of the print head using these electrothermal conversion elements, there is known a system for ejecting ink in parallel to a substrate in which the electro-thermal conversion elements are arranged (edge shooter type). In addition, as the other structure, there is known a system for ejecting ink perpendicularly to a substrate in which the electro-thermal conversion elements are arranged (side shooter type).

The conventional example in regard to a manufacturing method of this type of ink jet print head is as follows. First, heating resistors constituting electro-thermal conversion elements and conductor wirings for supplying power to the heating resistors are provided on a silicon substrate, and a protective film is provided on the conductor wirings. Thereafter, a pattern for an ink passage and a pressurizing chamber is formed by patterning of resist. Next, an ink passage forming material is coated and patterned, and the forming member for the ink passages including ejection openings and the like are provided. Thereafter, holes for supplying ink from a backside of the silicon substrate to the ink passages are formed in the silicon substrate. The resist is removed through the holes thus formed to complete formation of the ink passages including the ejection openings and the like. A flexible substrate for electrical connection of a printing element substrate to an apparatus main body is connected to the printing element substrate on which the ink passages including the ejection openings and the electrothermal conversion elements are thus provided.

FIGS. 1A to 1D are views showing a conventional example of a series of print head manufacturing processes as described above. As shown in FIG. 1A, first, a support plate for supporting the above-described printing element substrate is formed by joining a plate 16 and a plate 16A together. Next, as shown in FIG. 1B, the printing element substrates 100C and 100Bk as described above are joined to the plates 16 and 16A. Then as shown in FIG. 1C, a flexible wring substrate 11 which has openings surrounding respectively the printing element substrates 100C and 100Bk is joined on the support plate. Finally, as shown in FIG. 1D, electrical connection parts between the printing element substrates and the flexible wiring substrate are sealed by sealants 20A and 20B. More specifically, plating or a bowl bump is formed on a pad on the printing element substrate and then to the plating or the bowl bump, an inner lead wire at a side of the flexible wiring substrate is connected. In addition, for sealing this connection part, an inner lead bonding (ILB) sealant (electrical connection part sealant) is applied.

The sealants which are used in the electrical connection part between the printing element substrate and the flexible element substrate and which are provided at an upper side and a lower side of the inner lead wire are required to have properties which are different between the upper side and the lower side of the inner lead wire. More specifically, the sealing at the lower side of the inner lead is required so that the sealant passes through between the inner lead wires, flows along the inner lead wire and enters in until a backside of the inner lead wire for appropriately performing the sealing. Therefore, it is preferable that the viscosity of the sealant is low. On the other hand, in regard to the sealing at the upper side of the inner lead wire, it is preferable that the viscosity of the sealant is high and, after the curing, the sealant has a high resiliency. This is because appropriate sealing at the upper part of the inner lead wire is required to be performed so that the sealants stay in more than a given amount at the upper side of the inner lead wire. If the viscosity of the sealant is low, the sealant in amounts more than necessary may flow out from the upper side of the inner lead wire, and the sealing at the upper part on the inner lead wire may not be sufficiently performed. In addition, when the periphery of the ejection openings in the print head is wiped, the sealant at the electrical connection part is rubbed by the blade. For improving the durability in the sealant against this rubbing, it is preferable that the sealant has a high resiliency after the curing.

For the reason as described above, it is known that two kinds of adhesives are used as the sealant. FIG. 1D shows an example using the two kinds of sealants 20A and 20B.

However, use of two kinds of the sealants in regard to the viscosity of the sealant as described above possibly raises the problem that the manufacturing process composed of a coating process of the sealant and the subsequent process of thermal curing of the sealant is complicated. Particularly because of continuously using sealants having different properties, the condition of the thermal curing is supposed to be more precise. Further, in a case where the curing state of the sealant is unstable since the precise condition of the thermal curing is not satisfied, the sealing effect may be inappropriate by the melting of two kinds of the sealants with each other.

For overcoming such a problem, Japanese Patent Laid-Open No. 2004-351754 describes a technology in which one kind of a sealant is used and also a requirement for the sealant at the upper side of the inner lead wire is satisfied by a cover member separately provided. More specifically, as shown in FIGS. 2A and 2B, cover members 21 are provided for covering an entirety of the inner lead wires, and one kind of the sealant is poured inside the cover member 21 to be cured.

However, in the method described in Japanese Patent Laid-Open No. 2004-351754, it is required to additionally provide the cover member. Inconsequence, it raises the problem with an increase of the number of the process and complication of the print head structure.

SUMMARY OF THE INVENTION

An object of the present invention is to provide a manufacturing method of a print head and the print head which can sufficiently seal a connection part of an inner lead wire using one kind of a sealant, without complication of a manufacturing process and a structure of the print head.

In a first aspect of the present invention, there is provided a manufacturing method of a print head that includes a printing element substrate on which ink ejection openings are provided, an electrical wiring, and a connection part connecting the printing element substrate and the electrical wiring by means of a lead wire, said method comprising the step of sealing the connection part by applying an activation energy ray-setting composition to the connection part, wherein in said sealing step, an activation energy ray is irradiated to the activation energy ray-setting composition between beginning of application of the activation energy ray-setting composition to the connection part and a completion of application of the activation energy ray-setting composition to the connection part.

According the above arrangement, an activation energy ray-setting composition is irradiated with activation energy rays while applying the activation energy ray-setting composition to the connection part. In consequence, since it takes a predetermined time until the curing of the activation energy ray-setting composition begins after the irradiation of the activation energy rays, the composition can flow along the lead wire and enter into the lower side of the lead wire during that time. As a result, a required amount of the sealant can be applied to the lower side of the lead wire. Thereafter, the activation energy ray-setting composition begins to be cured and is gradually cured. In consequence, the composition can gradually accumulate at the upper side of the lead wire to provide a sufficiently thick sealant, without flowing into the lower side of the lead and flowing out into locations other than the sealing location.

As a result, it is possible to manufacture a print head which can sufficiently seal a connection part in an inner lead wire using one kind of a sealant, without complication of the manufacturing process and the head structure of the print head.

Further features of the present invention will become apparent from the following description of exemplary embodiments (with reference to the attached drawings).

DESCRIPTION OF THE EMBODIMENTS

Hereinafter, embodiments of the present invention will be in detail explained with reference to the drawings.

Figure 3:
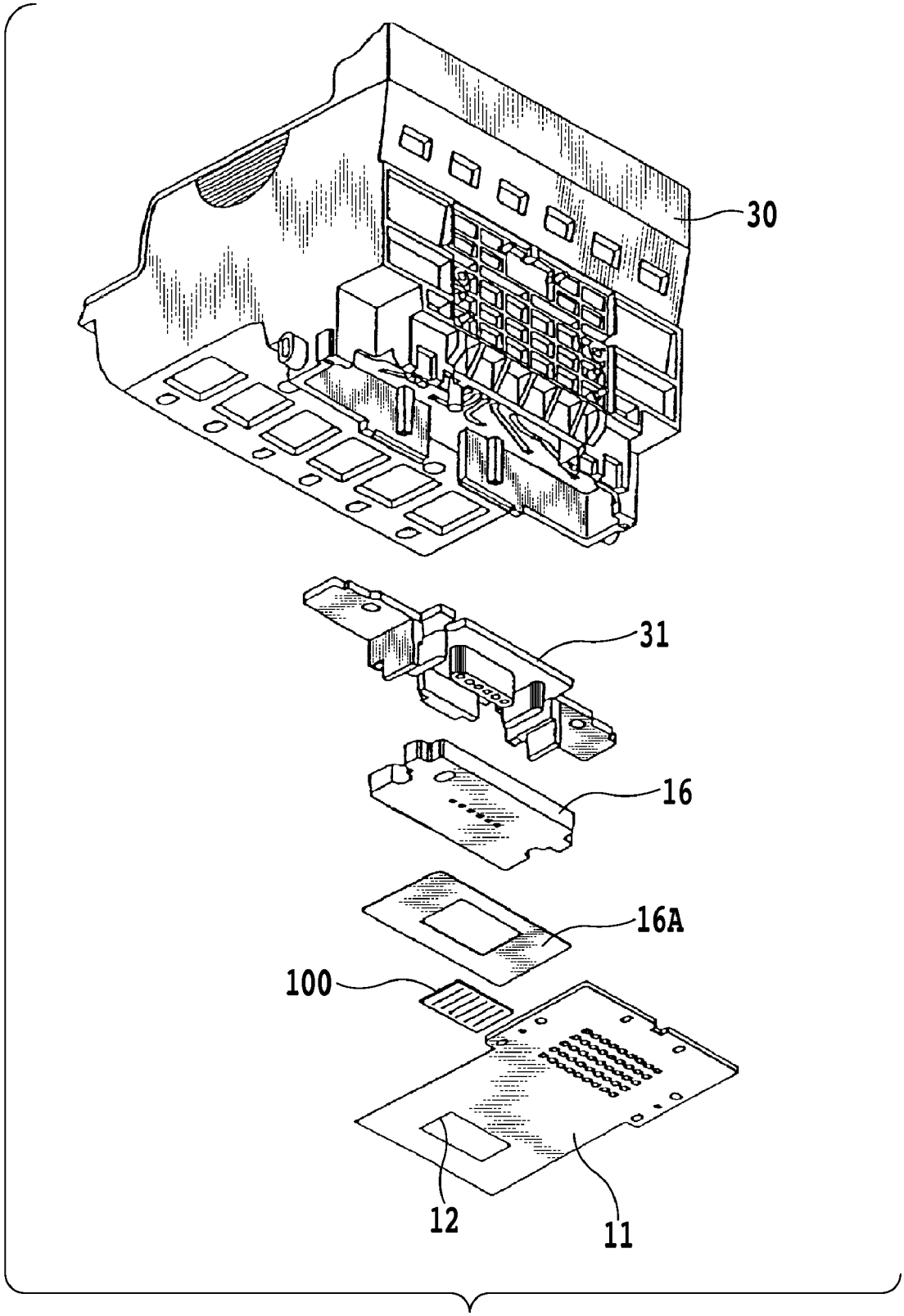
FIG. 3 is an exploded perspective view showing a structure of a print head according to an embodiment of the present invention.

FIG. 3 is an exploded perspective view showing a structure of a print head according to an embodiment of the present invention. As shown in this figure, the print head of the present embodiment is attached to a lower side of a holder 30 for mounting an ink cartridge for reserving ink. The print head comprises mainly a flexible wiring substrate 11 as electrical wiring provided with inner lead wires 12, a printing element substrate 100, support plates 16 and 16A and an ink supply passage member 31.

Figure 1A:
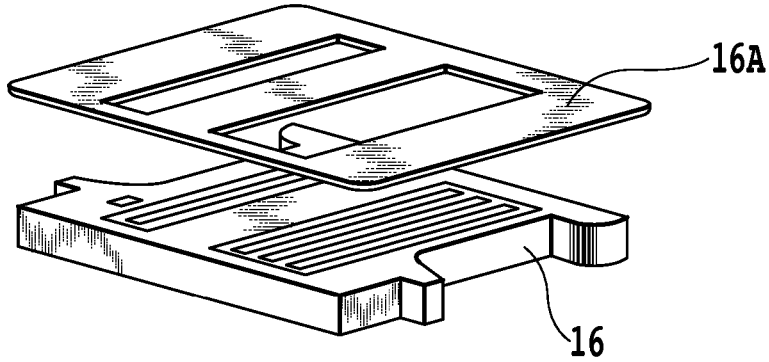
FIGS. 1A to 1D are views showing one conventional example of a series of print head manufacturing processes as described above.
Figure 1B:
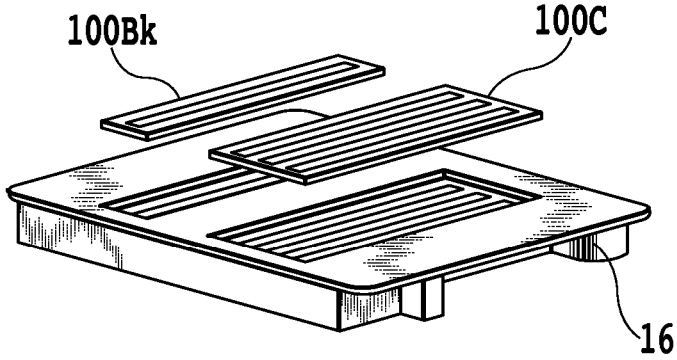
Figure 1C:
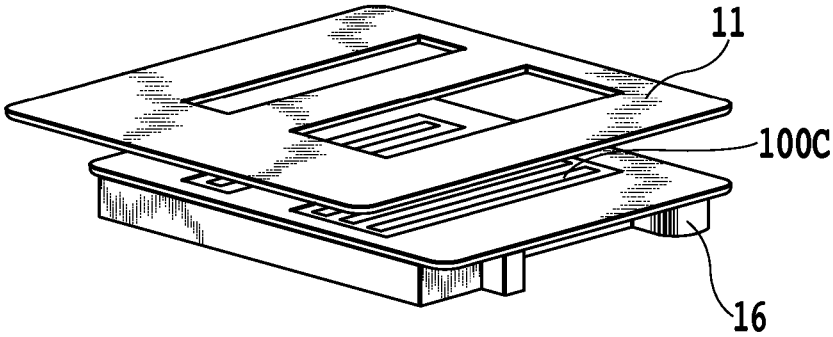
Figure 1D:
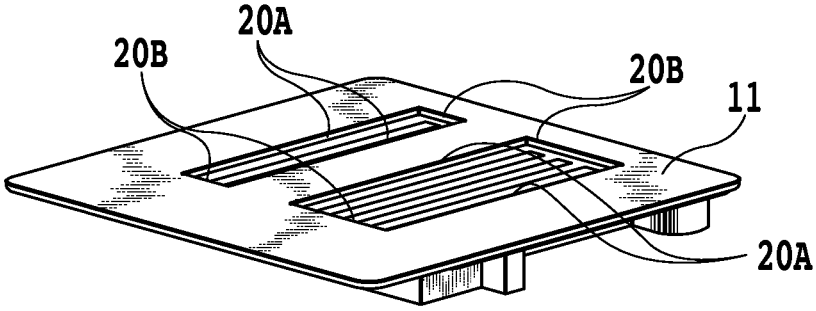
Figure 2A:
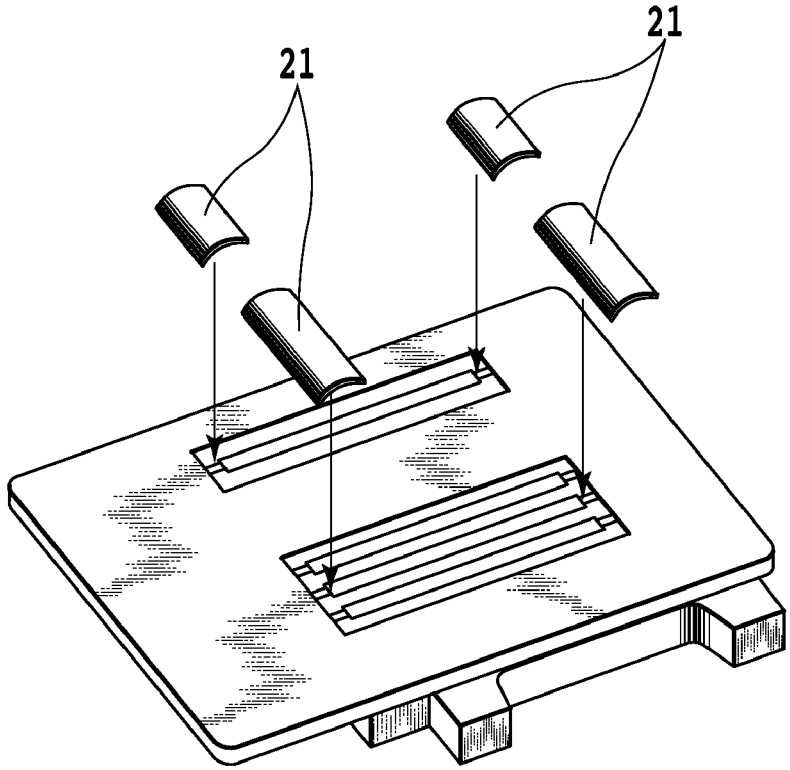
FIGS. 2A and 2B are views showing another conventional example of print head manufacturing processes.
Figure 2B:
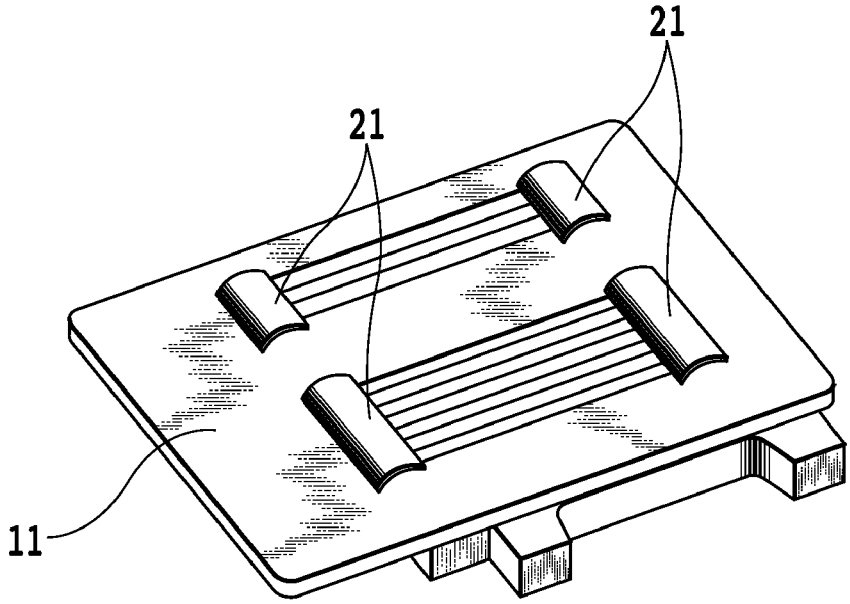
Figure 4:
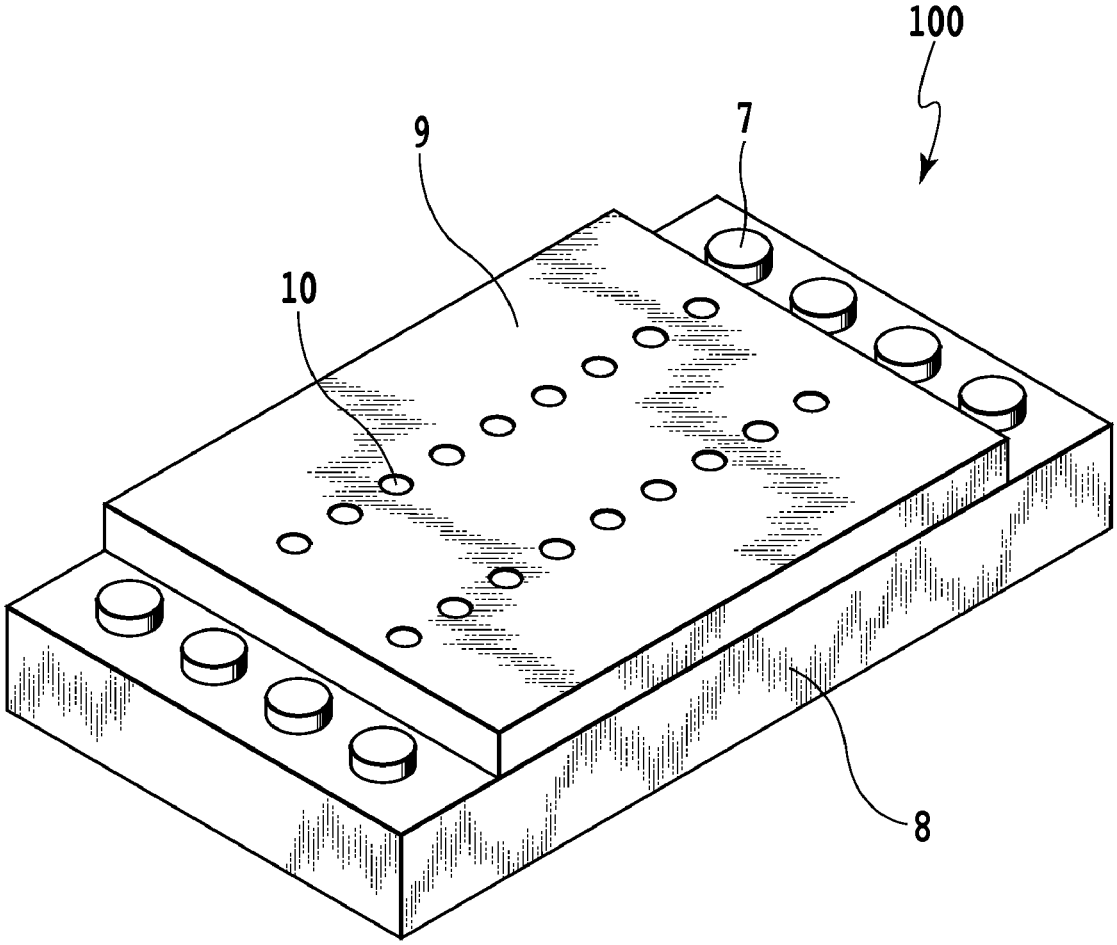
FIG. 4 is a perspective view showing a printing element substrate according to the embodiment.

FIG. 4 is a perspective view showing the printing element substrate according to the present embodiment. The printing element substrate 100 is made by forming a passage forming member 9 on a silicon substrate 8. Ejection openings 10 of ink, a pressuring chamber communicated with the ejection opening, ink passages (not shown) and the like are formed in the passage forming member 9. Bumps 7 are provided at ends of both sides of the printing element substrate 100 for connecting to the inner lead wires of the flexible wiring substrate. This printing element substrate 100 is connected to the flexible wiring through the manufacturing process as described in FIG. 1. However, the sealing process of the present embodiment is, as described later in reference to FIG. 6, different from the process shown in FIG. 1D.

Figure 5:
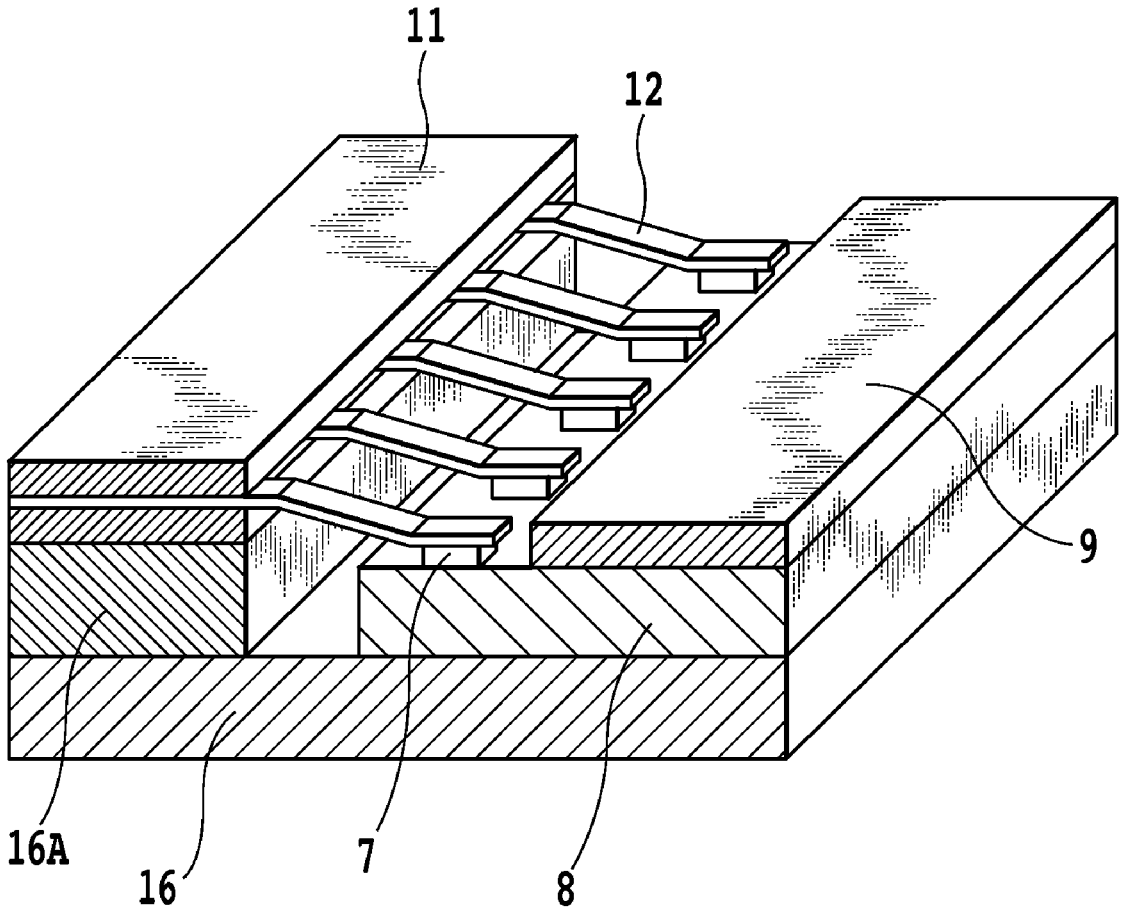
FIG. 5 is a view showing an electrical connection part between the printing element substrate and a flexible wiring substrate according to the embodiment.

FIG. 5 is a view showing an electrical connection part between the printing element substrate 100 and the flexible wiring substrate in the present embodiment. More specifically, FIG. 5 shows a state where the inner lead wires 12 of the flexible wiring substrate 11 and the bumps 7 of the printing element substrate 100 are connected to each other, that is, a state before the sealing is made.

A gap between the lead wires 12 is several ten am. When the sealant is applied to the lead wires from the upper side of the connection part, as described above, in a case where the viscosity of the sealant is low, the sealant enters excessively into a space between the respective lead wires and an amount of the sealant remaining on the lead wire is small, so that a sufficiently thick layer of the sealant can not be formed. Inversely, in a case where the viscosity of the sealant is high, the sealant does not enter into the space between the lead wires and a sufficiently thick layer of the sealant can be formed, but an amount of the sealant entering into the lower side of the lead wire is not sufficient.

On the other hand, in the embodiment of the present invention, as described later in FIG. 6, the sealant of a relatively low viscosity is used, and also the sealant is irradiated with the activation energy rays while applying the sealant. Thereby, at the first stage of the applying of the sealant, the sealant flows along the lead wire and enters into the lower side of the lead wire because of a low viscosity of the sealant to perform the sealing with a sufficient amount of the sealant at the lower side. In addition, the viscosity of the sealant gradually increases by irradiation of the activation energy rays, so that a sufficient amount of the sealant remains also at the upper side of the lead wire, making it possible to perform good sealing at the upper side.

Figure 6:
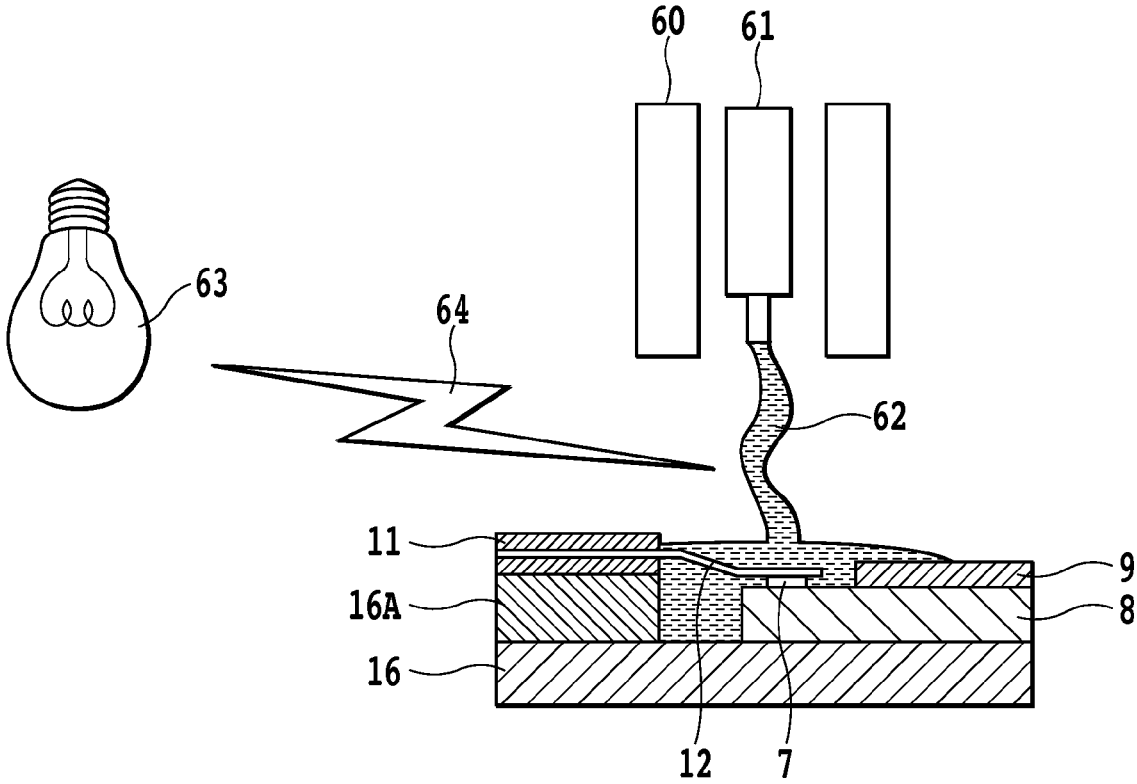
FIG. 6 is a view showing a sealing process, particularly to an electrical connection part between an inner lead wire and a bump in a manufacturing method of the print head according to an embodiment of the present invention.

FIG. 6 is a view showing a manufacturing method of the print head according to the embodiment of the present invention, and particularly shows the sealing process to the electrical connection part between the inner lead wire and the bump.

In FIG. 6, a cationic activation energy ray-setting composition 62 as a sealant is discharged from a syringe 61, which is shielded from activation energy rays 64 by a light shielding member 60. The activation energy ray 64 is emitted to the discharged sealant 62 from a lamp 63. Thereby, the cationic activation energy ray-setting composition 62 generates cations after the irradiating of the activation energy ray, but it takes a predetermined time until the curing of the composition begins. Therefore, the composition can pass through between the lead wires 12 during that time. In consequence, a required amount of the sealant can be applied to the lower side of the lead wire 12. Thereafter, the cationic activation energy ray-setting composition 62 as the sealant begins to be cured and is gradually cured. In consequence, the sealant can gradually accumulate at the upper side of the lead wire 12 to provide a sufficiently thick sealant thereon, without flowing through between the lead wires 12 into the lower side and flowing out into locations other than the sealing location. That is, it is possible to determine the timing for emitting the activation energy ray to the sealant in such a manner that within the period before the sealant begins to be cured after the irradiating of the activation energy ray, the sealant enters into the lower side of the lead wire to sufficiently perform the sealing at the lower side, and thereafter, begins to be cured to sufficiently perform the sealing at the upper side of the lead wire.

It should be noted that in a case of emitting the activation energy ray after the applying of the sealant to the connection part is completed, since the sealant has a relatively low viscosity, the sealant entering into the lower side of the lead wire increases in amounts and the sealant remaining on the upper side of the lead wire decreases in amounts. Further, since the activation energy ray is hard to be reached to the lower side of the lead wire, an object of the present embodiment of gradually curing the sealant can not be achieved. On the other hand, in a case where after the activation energy ray is emitted to all the sealants to be applied, the sealant is applied (discharged), since the time until the sealant is cured after the emitting of the activation energy ray is short, a sufficient amount of the sealant can not enter into the lower side of the lead wire during this short time. That is, in the embodiment of the present invention, the timing for emitting the activation energy ray to the sealant is a point after the sealant begins to be applied to the connection part (the sealant is in contact with the connection part) and a point before the applying of the sealant to the connection part (the sealant is in contact with the connection part) is completed. This timing is, as described above, the timing at which the lower side and the upper side of the lead wire respectively can be sufficiently sealed, and may be determined in accordance with a specification of the print head or the like.

Here, an example of the cationic activation energy ray-setting composition that can be used in the present embodiment is as follows.

It is preferable that the cationic activation energy ray-setting composition is formed of epoxy resin as a main component in light of ink resistance, adhesion, and reactivity. An example of the epoxy resin may include an alicyclic epoxy resin having high activity to a cation. An example of the aliphatic epoxy resin includes poly glycidyl ether of the polyhydric alcohol which has at least one alicyclic ring, a compound with a cyclohexene oxide structure or a compound with a cyclopentene oxide structure obtained by epoxidating a compound with a cyclohexene or a cyclopentene ring by an oxidizer, or a compound with a vinylcyclohexane oxide structure obtained by epoxidating with an oxidizer a compound which has a vinylcyclohexane structure. An example of the compound may include hydrogenation bisphenol A diglycidyl ether, 3,4-epoxycyclohexylmethyl 3,4-epoxycyclohexylcarboxylate, 3,4-epoxy-1-methylcyclohexyl 3,4-epoxy-1-methylcyclohexane carboxylate, 6-methyl-3,4-epoxycyclohexylmethyl 6-methyl-3,4-epoxy cyclohexane carboxylate, 3,4-epoxy-3-methylcyclohexylmethyl-3,4-epoxy-3-methylcyclohexane carboxylate, 3,4-epoxy-5-methylcyclohexylmethyl-3,4-epoxy-5-methylcyclohexane carboxylate, 2-(3,4-epoxycyclohexyl-5,5-spiro3,4-epoxy) cyclohexane-metadioxane, bis(3,4-epoxycyclohexylmethyl) adipate, vinylcyclohexene dioxide, 4-vinylepoxycyclohexane, bis(3,4-epoxy-6-methylcyclohexylmethyl)adipate, 3,4-epoxy-6-methylcyclohexyl carboxylate, methylenebis (3,4-epoxycyclohexane), dicyclopentadiene diepoxide, ethylene glycol di (3,4-epoxycyclohexylmethyl) ether, ethylene bis (3,4-epoxy cyclohexane carboxylate), epoxy hexahydrophthalic acid dioctyl, or epoxy hexahydrophthalic acid di-2-ethylhexyl.

There is epoxy of a glycidyl ether group having high activity to the cation, and on the other hand, there is epoxy of a glycidyl ether group having not so high activity to the cation. An example of a material of the epoxy may include an aromatic epoxy resin, polyhydric phenol having at least one aromatic ring, or polyglycidyl ether of the alkylene oxide additive, for example, bisphenol A, bisphenol F, or glycidyl ether of a compound to which alkylene oxide is further added to them, an epoxy novolak resin, bisphenol A novolak diglycidyl ether, or bisphenol F novolak diglycidyl ether.

A specific example of an aliphatic series epoxy resin may include aliphatic polyhydric alcohol or poly glycidyl ether of the alkylene oxide adduct, poly glycidyl ester of aliphatic series long chain polybasic acid, a compound with epoxy obtained by oxidizing aliphatic series long chain unsaturated hydrocarbon with an oxidizer, a homopolymer of glycidyl acrylate or glycidyl methacrylate, or a copolymer of glycidyl acrylate or glycidyl methacrylate. A typical compound may include 1,4-butanediol diglycidyl ether, 1,6-hexanediol diglycidyl ether, triglycidyl ether of glycerin, triglycidyl ether of trimethylolpropane, tetraglycidyl ether of sorbitol, glycidyl ether of polyhydric alcohol, such as hexa glycidyl ether of a dipentaerythritol, diglycidyl ether of a polyethylene glycol, and diglycidyl ether of a polypropylene glycol, poly glycidyl ether of the polyether polyol obtained by adding one sort or two sorts or more of alkylene oxides to aliphatic polyhydric alcohol, such as propylene glycol and glycerin, or diglycidyl ester of aliphatic series long chain dibasic acid. Further, the typical compound may include monoglycidyl ether or phenol of aliphatic higher alcohol, cresol, butylphenol, monoglycidyl ether of the polyether alcohol obtained by adding an alkylene oxide to them, glycidyl ester of higher fatty acid, epoxidized soybean oil, epoxy stearic acid octyl, epoxy stearic acid butyl, or epoxidation linseed oil.

These epoxy resins are blended as needed, thereby making it possible to adjust the viscosity or the reaction speed.

In addition, in the present embodiment, for improvement of adhesion, reduction of viscosity and reactive adjustment, a silane coupling agent, oxetane, vinyl ether and the like can be added as needed. In addition, a filler such as quartz may be added.

An example of a photo cationic polymerization initiator may include an aromatic onium salt (refer to J. POLYMER SCI: Symposium No. 56 383-395 (1976)), Irgacure 261 (trade mark) distributed by Ciba-Geigy Co., SP-150 (product name) and SP-170 (product name) distributed by Asahi Denka Co., triazine A, triazine PMS, triazine PP, and triazine B distributed by Nihon Siber Hegner Co., or photo initiator 2074 distributed by Rhodia Japan. In addition, for promoting photo polymerization, a thermal cationic polymerization initiator may be used together as needed.

An example of the thermal cationic polymerization initiator may include sun-aid SI-60L (product name), sun-aid SI-80L (product name), sun-aid SI-100L (product name) distributed by SANSHIN CHEMICAL INDUSTRY Co., CP-66 (product name), CP-77 (product name) or use of an aromatic onium salt, or a reducer together with them (refer to Japanese Patent Laid-Open 54-102394 or J. POLYMER SCI: Polymer chemical Edition Vol 121, 97-109 (1983)).

EXAMPLE 1

Composition 1

| | |
|---|---|
| Celloxide 2021 (Daicel Chemical Industries Co.) | 70 |
| EPOLEAD GT (Daicel Chemical Industries Co.) | 30 |
| Silane coupling agent A-187 (Nippon Unicar Co.) | 5 |
| Adeka optomer (ADEKA Co.) | 2 |

The sealing is performed so that a cationic UV cured epoxy resin composition made of Composition 1 is applied to the sealing part while being irradiated with UV light having an illumination intensity of 100 mw/cm2m for one second. Thereafter, for completely curing the sealant, thermal cure is performed at 80° C. for one hour. The viscosity which is 3 Pa·s before UV irradiation does not change until the order of 3 sec after UV irradiation, but the sealant is substantially cured after the order of 10 sec passed.

Since the sealant has a low viscosity until immediately after the irradiation, the sealant can enter into a fine space between the lead wires and thereafter, is cured. In consequence, the sealant is accumulated sequentially and a sufficient amount of the sealant can be applied also at the upper side of the lead wire.

Since the base resin of Composition 1 is formed of only aliphatic epoxy having a high reactivity, it can be cured at a relatively low temperature. In the present embodiment, the composition is formed of a member having a relative thermal resistance, but in a case where an engineering plastic such as modified PPO is used as the forming member, it is effective since the composition can be completely cured at a low temperature.

EXAMPLE 2

Composition 2

| | |
|---|---|
| EPICOAT 807 (Japan Epoxy Resin Co.) | 70 |
| EPICOAT 152 (Japan Epoxy Resin Co.) | 30 |
| Silane coupling agent A-187 (Nippon Unicar Co.) | 5 |
| Adeka optomer SP-170 (ADEKA Co.) | 2 |
| Adeka optomer CP-66 (ADEKA Co.) | 1 |

The sealing is performed by applying the sealant to the sealing part while a cationic UV cured epoxy resin composition made of Composition 2 is irradiated with UV light having an illumination intensity of 100 mw/cm2m for one second. At this point, the sealing is performed while heating the printing element substrate to be sealed at 100° C. Thereafter, for completely curing the sealant, thermal cure is performed at 150° C. for one hour. The viscosity of composition 2 is 7 Pa·s. The base resin of Composition 2 is formed of epoxy of glycidyl ether having reactivity lower than the aliphatic epoxy used in Composition 1. Therefore, Composition 2 is heated since it is not cured for a short time at room temperatures after UV irradiation. In a case of heating Composition 2, Composition 2 was cured in approximately 15 sec.

It is preferable that the viscosity of the cationic UV cured composition is equal to or less than 35 Pa·s in a case when a distance between the lead wires is several ten μm. This is because when the viscosity is high, it takes time to enter in between the lead wires, leading to poor productivity. In a worse case, the resin does not enter in between the lead wires, possibly producing a defective product.

EXAMPLE 3

The coating was performed while a cationic UV cured epoxy resin composition and lead wires made of Composition 1 are irradiated with UV light having an illumination intensity of 10 mw/cm2m. When the resin composition is accumulated to the upper side of the lead wire, the illumination intensity is increased to 200 mv/cm$^2$, the coating is performed until the lead wire is completely covered. Thereafter, for completely curing the sealant, thermal cure is performed at 100° C. for one hour. It is easier to control the height of the sealant because of a faster curing at the upper side of the lead wire as compared to Embodiment 1, thereby improving also the productivity.

EXAMPLE 4

Composition 3

| | |
|---|---|
| CXT-221 (Toagosei Co.) | 70 |
| Celloxide 2021P (Daicel Chemical Industries Co.) | 30 |
| Silane coupling agent A-187 (Nippon Unicar Co.) | 5 |
| Adeka optomer SP-170 (ADEKA Co.) | 2 |
| Adeka optomer CP-66 (ADEKA Co.) | 1 |

Composition 3 is made of oxetane CXT-221 of low viscosity which can be ejected by an ink jet printing apparatus, as a base. In addition to it, celloxide 2021P of epoxy resin is together used to obtain a synergy effect of a speed of a polymerization reaction start of epoxy resin and a final conversion rate of oxetane. In consequence, a cured substance of a high cross-linking density can be obtained even at a relatively low temperature.

The cationic UV cured resin composition made of such Composition 3 is packed in Fine cartridge BC-70 made by Canon Inc. which is then ejected. The ejection amount is 30 pl. The coating is performed while the ejected resin composition and the lead wires were irradiated with UV light having an illumination intensity of 200 mw/cm2m. The ejection is performed until the lead wire is completely covered. Thereafter, for completely curing the sealant, thermal cure is performed at 100° C. for one hour.

The ejection amount changes depending on a width between lead wires, but it is preferable that the ejection amount is equal to or less than 100 pl in such a manner that the composition can pass through between the lead wires.

Components are, as shown in FIG. 3, attached to the printing element device sealed and manufactured as described above, thus manufacturing a print head. When a printing endurance test and a storage test at 60° C. for four months were made in this manufactured print head, any abnormality was not found.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-161759, filed Jun. 20, 2008, which is hereby incorporated by reference herein in its entirety.

What is claimed is:

1. A manufacturing method of a print head comprising:

a step of sealing a connection part connecting a printing element substrate on which ink ejection openings are provided and an electrical wiring with a lead wire by applying an ultraviolet curable composition to the connection part, wherein in said sealing step, an ultraviolet ray is irradiated on the ultraviolet curable composition before the application of the ultraviolet curable composition to the connection part is terminated.

2. A manufacturing method as claimed in claim 1, wherein said sealing step performs the sealing with heating the lead wire.

3. A manufacturing method as claimed in claim 1, wherein in said sealing step, the ultraviolet ray is irradiated with changing illumination intensities of the ultraviolet ray.

4. A manufacturing method as claimed in claim 1, wherein said sealing step applies the ultraviolet curable composition using a print head in an ink jet printing apparatus.

5. A manufacturing method as claimed in claim 4, wherein an amount of the ultraviolet curable composition applied by using the print head in the ink jet printing apparatus is 100 pl or less.

6. A print head manufactured by the manufacturing method as claimed in any one of claims 1 to 4.

7. A manufacturing method as claimed in claim 1, wherein in said sealing step, the ultraviolet ray is irradiated on the ultraviolet curable composition when the ultraviolet curable composition begins to be discharged from a syringe.

8. A manufacturing method as claimed in claim 1, wherein in said sealing step, in providing the ultraviolet curable composition to both sides of the lead wire, the application of the ultraviolet curable composition is performed at one side of the lead wire.

9. A manufacturing method as claimed in claim 8, wherein after the ultraviolet curable composition is accumulated at the upper side of the lead wire, an illumination intensity of the ultraviolet ray is increased.

* * * * *